United States Patent [19]

Green et al.

[11] Patent Number: 4,689,927

[45] Date of Patent: Sep. 1, 1987

[54] WALKWAY FOR A SLOPING ROOFTOP

[75] Inventors: William J. Green, Lake Forest; Ralph P. Semmerling, Arlington Heights, both of Ill.

[73] Assignee: USG Industries, Inc., Chicago, Ill.

[21] Appl. No.: 937,324

[22] Filed: Dec. 3, 1986

[51] Int. Cl.[4] ..... E04D 13/12; E04G 3/00

[52] U.S. Cl. ..... 52/180; 182/45; 248/237

[58] Field of Search ..... 52/180, 177, 41–44; 248/237, 297.3, 558, 300; 182/45

[56] References Cited

U.S. PATENT DOCUMENTS

| | | | |
|---|---|---|---|
| 1,341,597 | 5/1920 | Showalter | 248/237 |
| 2,243,723 | 5/1941 | Tench | 52/180 X |
| 2,326,600 | 8/1943 | Alvond | 52/180 X |
| 2,840,424 | 6/1958 | Broderick | 248/237 |
| 4,401,184 | 8/1983 | Sherry | 248/237 X |
| 4,450,935 | 5/1984 | Gustavus | 182/45 |
| 4,458,783 | 7/1984 | Stakes | 182/45 |

FOREIGN PATENT DOCUMENTS

| | | | |
|---|---|---|---|
| 16534 | 10/1980 | European Pat. Off. | 52/180 |
| 1240643 | 5/1967 | Fed. Rep. of Germany | 182/45 |
| 2549113 | 1/1985 | France | 52/177 |
| 7711477 | 5/1979 | Sweden | 182/45 |
| 459521 | 9/1968 | Switzerland | 52/180 |

*Primary Examiner*—J. Karl Bell

*Attorney, Agent, or Firm*—Robert M. Didrick; Samuel Kurlandsky; Robert R. Robinson

[57] ABSTRACT

An adjustable, U-shaped support stand is disposed transversely between an expanded metal walkway and a roof so that the walkway may be made level although the roof slopes or may be inclined with respect to the roof. The support stand has a U-shaped base comprising a foot, a short leg and a long leg, each leg having spaced apart columns of holes. Connected to each leg are extensions having an oval slot and a hole spaced apart in accordance with the columns of holes on the legs. Alignment of the slots and holes in the extensions with the appropriate holes in the legs allows the extended legs to be of different heights with respect to each other and also allows one end of an extended leg to be higher than the opposite end. The expanded metal walkway may thus be levelled even though the roof slopes in both the lateral and longitudinal direction under the walkway.

4 Claims, 3 Drawing Figures

WALKWAY FOR A SLOPING ROOFTOP

This invention relates to the use of expanded metal gratings as elevated walkways on roofs and other structures which need to be protected from the pounding of foot traffic. It relates particularly to such elevated walkways on sloping rooftops. It also relates to sloping elevated walkways on rooftops, flat or otherwise.

Rooftops on commercial buildings, although appearing to be flat, usually have a built-in slope for drainage purposes. Large roofs may have several drainage areas, each having their own slope. Certain kinds of roof may slope in two different directions simultaneously.

A level surface on a rooftop walkway is usually desirable for safety purposes. This is particularly true in regard to the lateral span of the walkway. A longitudinally rising walkway may be necessary, however, when it leads to a machinery platform or the like which is built above the roof.

It is an object of this invention, therefore, to provide an elevated walkway system which will accommodate the need for a level walkway on sloping roof.

It is another object of this invention to provide an elevated walkway system which will accommodate the need for a sloping walkway.

It will be seen from the drawings attached hereto and the description thereof that said objects and others which will become apparent are indeed achieved by this invention, which is:

A rooftop walkway comprising a longitudinal, expanded metal plank disposed at an acute angle to the roof on which the walkway rests, and an adjustable, U-shaped support stand to which the plank is fastened transversely; the support stand comprising a base, a pair of divergent legs connected to the base, and an extension member connected to each leg; each leg having a plurality of holes arranged in at least two spaced apart columns, and each extension member having a web and an outwardly extending flange connected to the plank, the webs having a pair of holes spaced apart in correspondence with the columns, wherein the holes in the extension members are aligned with the holes in the legs so that the base of the support stand and the plank are in intersecting planes.

Turning now to the drawings.

Figure 1:
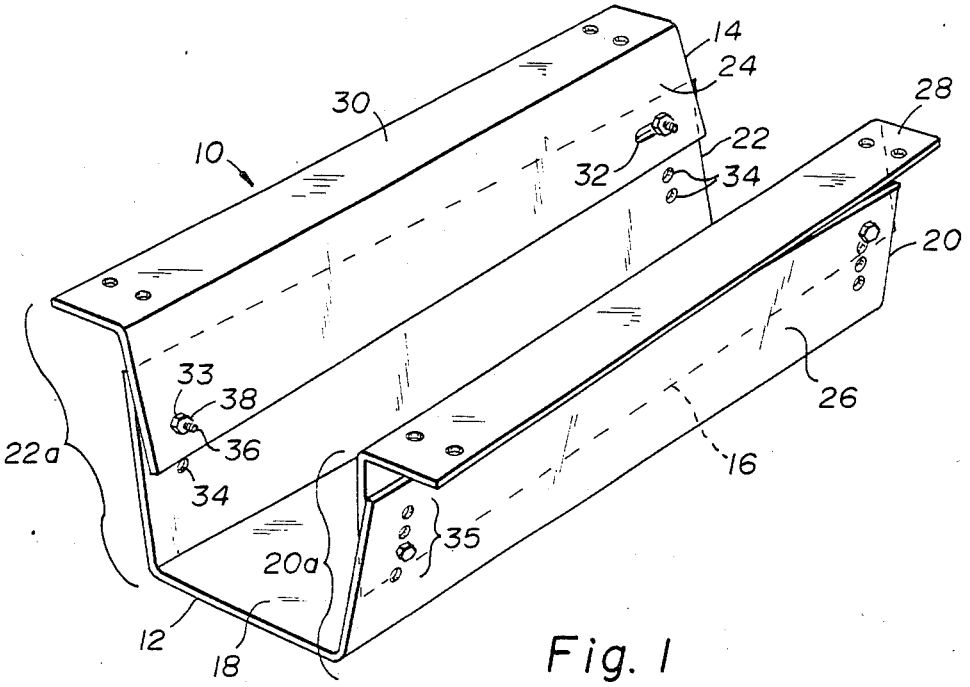
FIG. 1 is a perspective view of an adjustable support stand for an elevated walkway.

In FIG. 1, the U-shaped support stand 10 is an assembly of the base member 12 and the extensions 14 and 16. The base member 12 comprises the foot 18, the short leg 20, and the long leg 22. The extensions 14 and 16 are interchangeable, being made up of the webs 24 and 26 and the flanges 28 and 30, respectively. As shown in FIG. 1, the extended legs **20*a* and 22*a* are of unequal height overall and the distal ends of each are higher than the proximate ends. Thus, the support stand 10 will compensate for both longitudinal and lateral slopes of a roof on which the stand rests so that a walkway over the sloping roof will be level. Adjustment of the height of each leg 20*a* and 22*a* is done by aligning the oval slot 32 and the hole 33 in the webs 24 and 26 with the appropriate holes 34 which are arrayed in the spaced apart columns 35 in the legs 20 and 22 before the assembly is completed with the bolts 36 and the nuts 38**.

Figure 2:
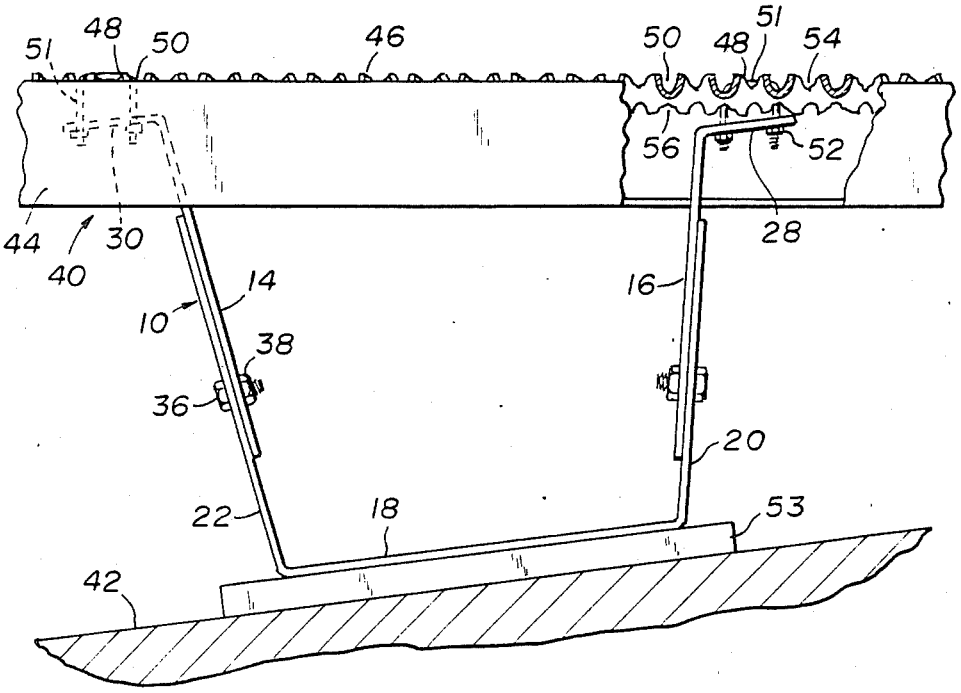
FIG. 2 is a side view, partially broken away, of an elevated walkway of this invention on a roof which slopes under the longitudinal span of the walkway.

In FIG. 2, the walkway 40 is horizontally level despite the slope of the roof 42 along the longitude of the walkway. The longitudinal channel 44 borders one edge of the expanded metal plank 46 which has alternating rows of ridges 48 and valleys 50 and is connected to the flanges 30 and 28 of the extended legs **22*a* and 20*a* by the U-bolts 51 and the nuts 52. In each ridge 48 and each valley 50 there are a plurality of slits 54 and 56, respectively. The support stand 10 rests on the protective pad 53**.

Figure 3:
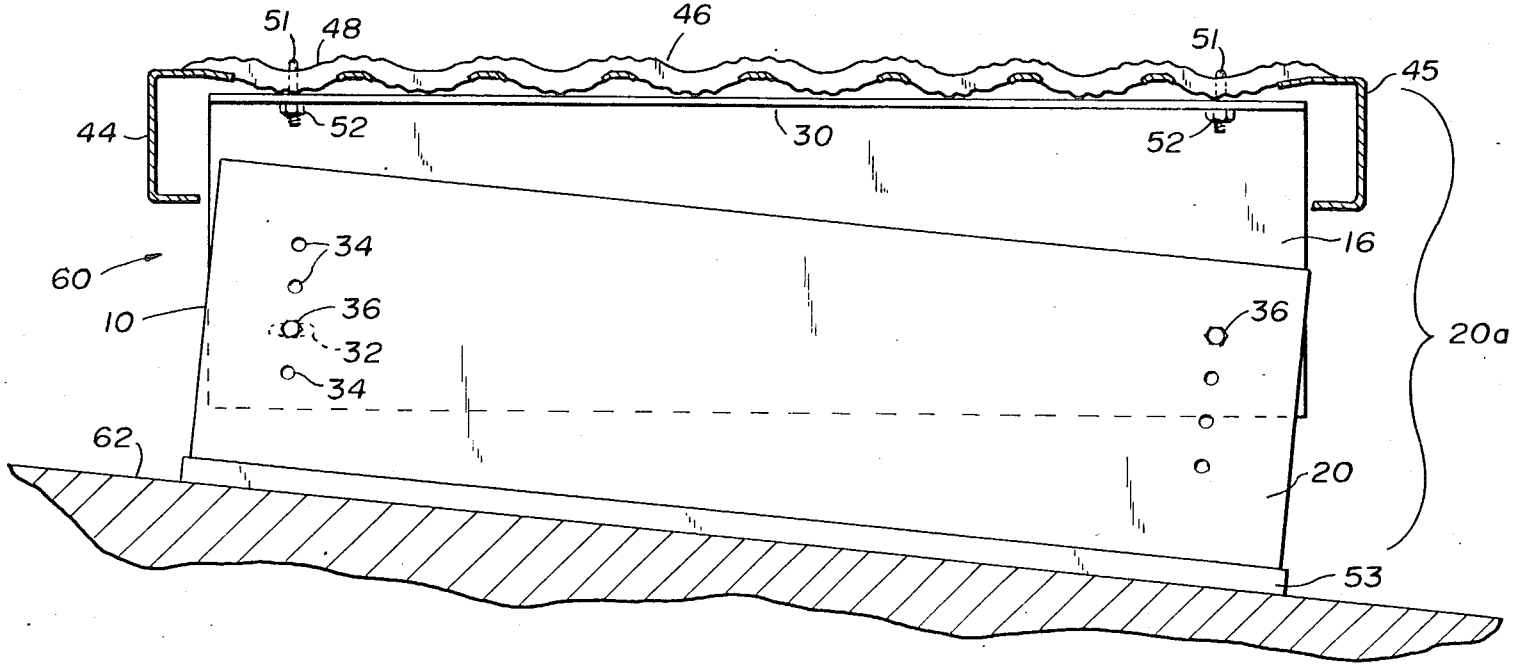
FIG. 3 is an end view of an elevated walkway of this invention on a roof which slopes under the lateral span of the walkway.

In FIG. 3, the right side of the extended leg **20*a* (and of the leg 22 *a*, which is not visible in this view) is raised above the left side so that the walkway 60 remains level on the laterally sloping roof 62. The alternating rows of the ridges 48 and the valleys 50 run parallel to the channels 44 and 45. The U-bolts 51 straddle the ridges 48 and pass through the slits 56 in adjacent valleys 50 (both hidden) and the flange 30. The plank 46 is fastened to the support stand 10 by the nuts 52**.

While a particular embodiment has been described, it will be understood that that embodiment may be modified within the spirit and scope of the apended claims.

The subject matter claimed is:

1. A rooftop walkway comprising a longitudinal, expanded metal plank disposed at an acute angle to the roof on which the walkway rests, and an adjustable, U-shaped support stand to which the plank is fastened transversely; the support stand comprising a base, a pair of divergent legs connected to the base, and an extension member connected to each leg; each leg having a plurality of holes arranged in at least two spaced apart columns, and each extension member having a web and an outwardly extending flange connected to the plank, the webs having a pair of slots spaced apart in correspondence with the columns, wherein the slots in the extension members are aligned with the holes in the legs so that the base of the support stand and the flanges of the extension members are in different planes.

2. The walkway of claim 1 wherein the expanded metal plank is horizontally level and the roof slopes longitudinally with respect to the plank, the slots in one extension member being aligned with a pair of horizontally spaced apart holes in one leg which are in a lower plane than those in the other leg with which the slots in the other extension member are aligned.

3. The walkway of claim 1 wherein the expanded metal plank is horizontally level and the roof slopes transversely with respect to the plank, the spaced apart slots in the extension members being aligned with columnar holes in the legs which are in different planes.

4. The walkway of claim 1 wherein one leg of the support stand is shorter than the other.

* * * * *